United States Patent [19]

Neilsen

[11] Patent Number: 4,570,469

[45] Date of Patent: Feb. 18, 1986

[54] KEY RETAINING DEVICE

[76] Inventor: Hildaur L. Neilsen, 2 Juniper St., Metuchen, N.J. 08840

[21] Appl. No.: 484,976

[22] Filed: Apr. 14, 1983

Related U.S. Application Data

[63] Continuation-in-part of Ser. No. 345,722, Feb. 4, 1982, Pat. No. 4,448,051, which is a continuation-in-part of Ser. No. 322,265, Nov. 17, 1981, Pat. No. 4,441,348.

[51] Int. Cl.[4] ..... E05B 11/00; E05B 73/00

[52] U.S. Cl. ..... 70/389; 70/19

[58] Field of Search ..... 70/389, 19, 63, 44, 70/456 R; 194/65, 51, 59

[56] References Cited

U.S. PATENT DOCUMENTS

| | | | |
|---|---|---|---|
| 4,090,380 | 5/1978 | Bianco | 70/19 |
| 4,441,348 | 4/1984 | Neilsen | 70/389 |
| 4,448,051 | 5/1984 | Neilsen | 70/389 |

*Primary Examiner*—Robert L. Wolfe

*Attorney, Agent, or Firm*—Stefan J. Klauber

[57] ABSTRACT

A key retaining device for capturing and selectively locking therein a portion of the working section of a key. When the key is locked in the device, its handle section is visible so that the presence of the key can be instantly determined without the unlocking of the apparatus, yet the key cannot be removed from the device until unlocked with a master key. Retention of the key within the housing is accomplished by a clamping mechanism employing a longitudinally sliding member having a wedge-like member which is urged toward the working section of the key upon the sliding member moving in a first longitudinal direction. The sliding member is moved by a bolt coupled to a lock which is rotated by a master key, and a nut which is held in a transverse slot of the slideable member. The master key when rotated in a second direction unthreads the bolt from the nut, moving the sliding member in the opposite longitudinal direction to release the wedge-like member which holds the key.

18 Claims, 11 Drawing Figures

KEY RETAINING DEVICE

BACKGROUND OF INVENTION

1. Field of Invention

This application is a continuation-in-part of my copending application Ser. No. 345,722, filed Feb. 4, 1982, (now U.S. Pat. No. 4,448,051) which is a continuation-in-part of Ser. No. 322,265, filed Nov. 17, 1981, (now U.S. Pat. No. 4,441,348).

This invention relates generally to systems for safeguarding keys from unauthorized use, and more specifically, relates to a key retaining device which permits a key to be prominently displayed, yet totally unavailable for use, unless released by authorized means.

2. Description of the Prior Art

There are many instances when it is desirable to leave a key proximate to the lock which it locks, yet to place the key in a circumstance such that it cannot be used by unauthorized personnel. An especially pertinent example arises in connection with automobile parking lots. Especially in lots with very large capacities, the tagging of ignition keys and their removal from the associated vehicle is not only time consuming, but also represents a substantial logistic and clerical task. The ideal situation would be one where the parking lot attendants are able to leave keys within the vehicle, yet at the same time placing the keys in a condition such that they cannot be employed by unauthorized personnel.

Typical of further environments where such need arises is the practice of real estate brokers leaving keys on the doors of houses which are for rent or sale in a locked box wherein a key is placed totally inside the box. In this situation, the authorized real estate broker can unlock the box and gain access to the key through the use of a master key so that the locked key can be used to open a door.

Various attempts have been made in the prior art to provide various apparatus which will be satisfactory for use in the above-described situations. Typical of these prior art apparatus are those disclosed in U.S. Pat. Nos. 3,636,742 issued to G. B. Ranay on Jan. 25, 1972; 3,695,067 issued to R. D. Bays on Oct. 3, 1972; 3,712,091 issued to R. J. Parent on Jan. 23, 1973; 3,742,741 issued to L. L. Cahan on July 3, 1973; and 3,744,281 issued to R. F. Logue et al. on July 10, 1973. Each of these apparatus provides a means for suspending a locked box from a suitable supporting surface and means for placing a key totally inside the locked box such that the locked box can be locked by a master key and access to the locked key can be precluded. The locked boxes are openable with a master key presumably only available to authorized personnel.

Unfortunately, all of the above apparatus suffer from at least two shortcomings. First of all, it is not known whether or not a key is disposed inside one of these locked boxes unless the locked box is actually opened. This is more than an inconvenience since considerable time can be lost in determining whether or not a key is available as a result of having to open a plurality of boxes. A second shortcoming is that any of these devices can be battered or broken open without any substantial risk of damaging the key disposed therein. As a result, unauthorized personnel can essentially strong arm the locked boxes open and be presented with a perfectly usable key to the total frustration of the intended purpose of these devices.

Another device which has recently come into use in parking lots, utilizes a cylindrical body having a transverse slot into which the working portion of an ignition key may be inserted. Jaws above and below the slot are then clamped against the key portion by advancing one of the jaws axially in the body. This is effected by means of a specially shaped wrench which engages a member threadingly received into at the cylinder. Such member in turn drives the one jaw toward the opposed jaw and intervening key. While this type of device has received a degree of acceptance, it suffers from the serious deficiency that a make-shift tool may be readily used to substitute for the aforementioned wrench, thereby circumventing the safeguard presumably provided by the device.

SUMMARY OF THE INVENTION

The present invention overcomes the problems and shortcomings associated with the prior art by providing a key retaining device which does not entirely enclose the retained key and which therefore permits visual inspection of the handle section of the key so that an observer instantly knows whether or not a key is engaged in the device. The present invention also totally destroys the useability of a key clamped therein if unauthorized extraction of the key is attempted in the apparently most logical manner, i.e., by grasping of the exposed handle section thereof and pulling on the same to try to remove the key. Further, the present invention assures that only an individual in possession of the authorized means of release will be able to operate the device so as to gain access to a retained key.

In accordance with the foregoing, it may be regarded as an object of the present invention to, provide a key retaining device which will retain and lock a key in a position such that it is unusable unless removed by authorized personnel.

A further object of the present invention is to provide a key retaining device which captures and selectively locks therein only the working section of an inserted key, leaving the handle section thereof visible.

A still further object of the present invention is to provide a key retaining device, which upon inspection by an interested party will reveal whether or not a key is present without unlocking of the device.

Still another object of the present invention is to provide a key retaining device which, if unauthorized withdrawal of a key therefrom is attempted, will tend to result in rendering the key inoperative.

Another object of the present invention is to provide a key retaining device for capturing and selectively locking therein a key, a variety of differently shaped and configured keys.

Yet another object of the present invention is to provide a key retaining device for capturing and selectively locking therein a key, which is suitable for manufacture in as many units as desired, each being openable by a master key.

A still additional and further object of the present invention is to provide a key retaining device which is simple in design, relatively inexpensive to manufacture, rugged in construction, durable, easy to operate, and efficient in operation.

Now in accordance with the present invention, the foregoing objects, as well as further objects as will become apparent in the course of ensuing specification, are achieved in a key retaining device which interacts with a key as to capture and selectively lock therein a portion of the working section of a key having a working section and a handle section. In accordance with the present invention, a device is provided which comprises a housing having end walls and a side wall forming a chamber therein, a slot being disposed through an end wall which is in communication with the chamber and being dimensioned to accommodate therethrough a portion of the working section of the key for insertion into the chamber, and means for selectively and releasably securing the portion of the working section of the key when inserted into the chamber of the housing through the end wall of the housing, the working section of the key being held by a cam wedge which is actuated to bear against the said key by a slidable member which moves longitudinally in the housing in response to a master key being inserted into and rotated at a lock at the opposed end of the housing. Rotation of the master key in the opposite direction, displaces the slide member in the opposite direction to release the cam wedge and the retained key.

In a preferred embodiment a spring cam is employed to hold the cam wedge in place to securely hold the key until the slide is released by the master key. The present invention is thus distinguished from the inventions disclosed and claimed in my prior applications in that the mechanism for securely holding the key place is simpler, and more economical to manufacture because it requires a minimum of parts.

DESCRIPTION OF ILLUSTRATIVE EMBODIMENT

The invention will be described in greater detail with reference to the accompanying drawing in which the same parts have the same reference numerals and:

DETAILED DESCRIPTION OF THE DRAWING

Figures 1, 2:
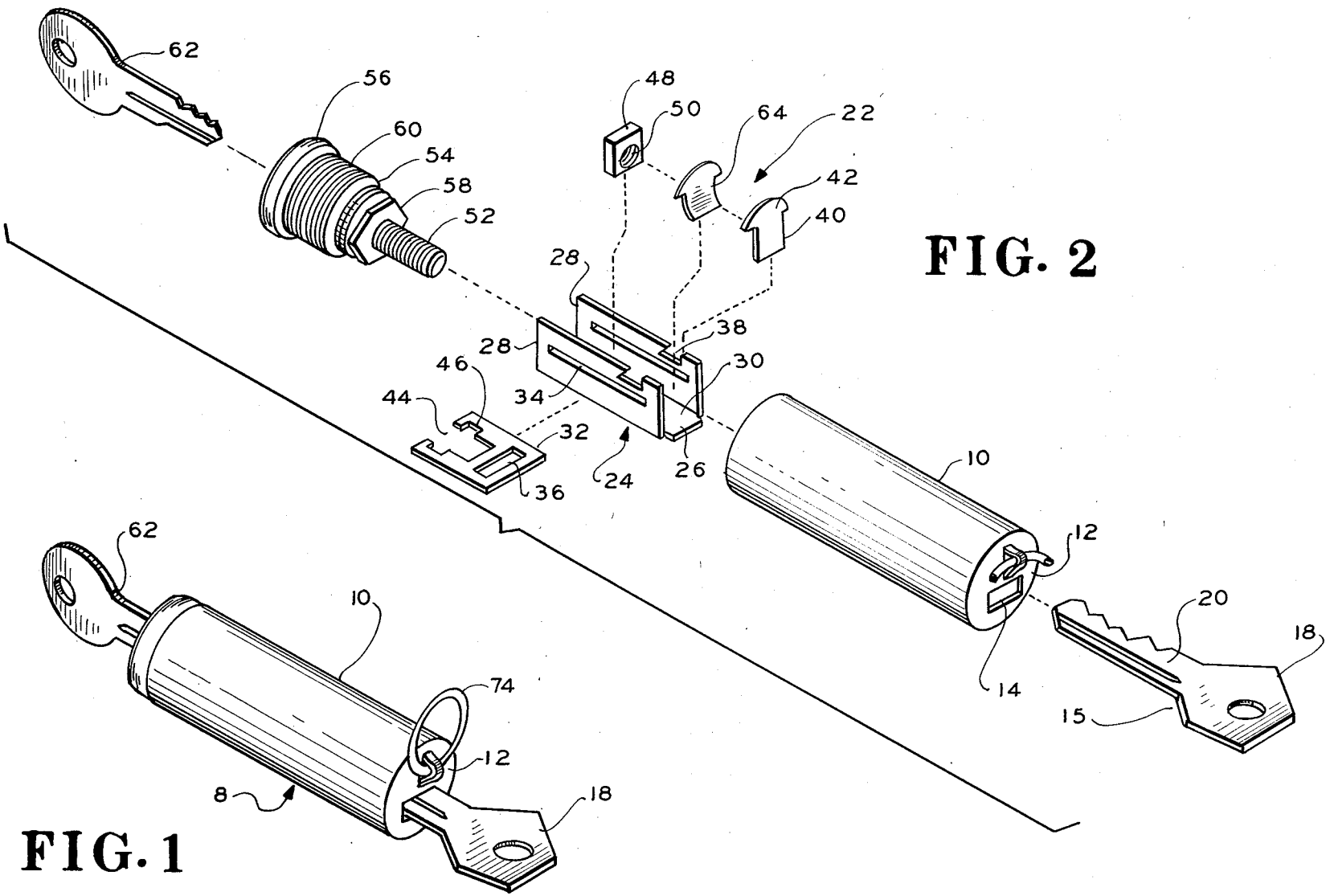
FIG. 1 is an assembly drawing of a key retaining device according to the invention shown in perspective.
FIG. 2 is an exploded view of the key retaining device.

Referring to the drawings, and in particular, FIGS. 1 and 2, the key retaining device 8 shown, comprises a generally hollow cylindrical housing 10, one end of which is closed by an end-wall 12 having an opening 14 for receiving a key 15 for an automobile, for example, having a handle section 18 and a working or profiled section 20.

A key-retaining mechanism 22 fits into the cylindrical housing as shown in FIG. 2. This key-retaining mechanism includes generally U-shaped member 24 which comprises a base 26 and walls 28 forming a channel 30. A sliding member 32 fits into longitudinal slots 34 in walls 28. Sliding member 32 has a transverse slot 36 which, in cooperating with an upper transverse slot 38 in the walls 28 receives a cam wedge 40, the head 42 of which fits into slot 38.

Sliding member 32 has an aperture 44 which opens into a transverse slot 46, spaced from slot 36, for receiving a nut 48 having threads 50, into which bolt 52 fits and engages the threads 50 of nut 48.

Nut 48 snugly fits in slot 46. Bolt 52 is connected to barrel 54 of an otherwise conventional cylinder lock 56 by a nut 58 which is threaded on bolt 52. Lock barrel 54 has external threads 60 which engage internal threads (not shown) in housing 10.

Figure 3:
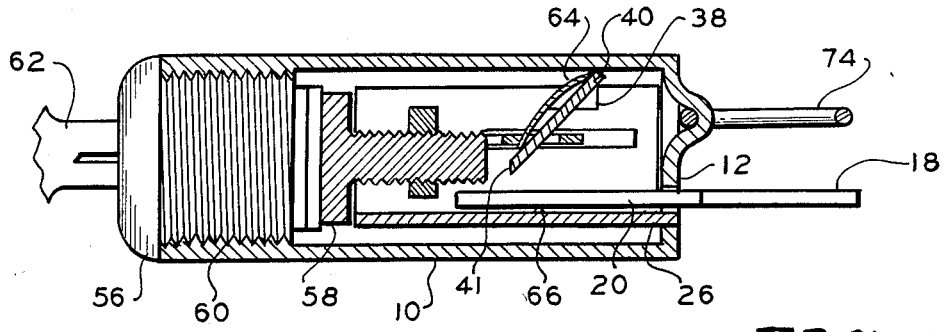
FIG. 3 is a sectional view of the device for engaging and releasably securing the working section of the key with the key released.

Insertion and rotation of master key 62 into lock 56 rotates the cylinder of lock 56 and bolt 52 which is consequently threaded out of (or into) nut 48. (Nut 48 preferably carries left hand threads so that it "moves away" from bolt 52 as the latter is turned in a clockwise direction.) This causes slide member 32 to move longitudinally (to the right in the drawing) within U-shaped member 24. In doing so, cam wedge 40 is tilted to a more vertical orientation (i.e. wedge 40 is rotated counterclockwise in the sense of FIGS. 3 and 4), as the bolt is threaded out of the nut (FIG. 4), whereby the bottom beveled edge 41 of member 40 engages the profiled section 20 of the key, and the upper edge 65 of member 40 abuts the interior of the housing 10 to effect a firm wedging action. Clearly the wedging action thereby achieved is such that any attempt to remove the key 15 will only cause a more firm wedging action—further resisting withdrawal. Conversely, if the lock barrel is rotated (counterclockwise) to thread the bolt into the nut, the slide moves toward the left (FIG. 3) tilting wedge-like member away from and releasing the key.

Figure 4:
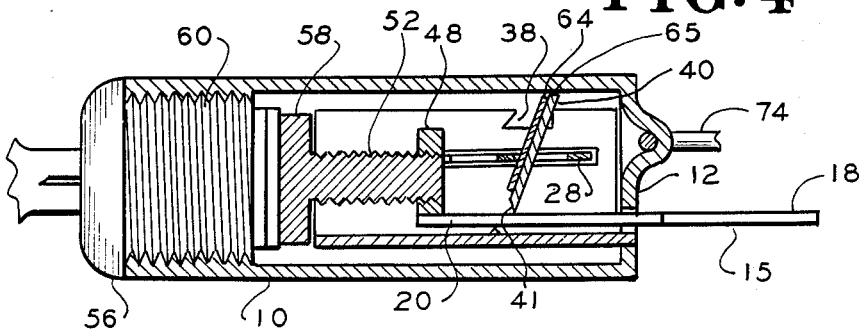
FIG. 4 is a sectional view of the device with the key securely held therein.

In order to more firmly secure the key when the wedge-like member 40 is moved to the right, as in FIG. 4, an additional spring cam wedge 64, thinner than cam wedge 40, and bent slightly to the right (i.e. with its concave face in contact with wedge 40), fits into slots 36 and 38 behind cam wedge 40. This element 64 acts as a spring urging cam wedge 40 against the profiled portion 20 of the key when the slide 32 is moved to the right with respect to member 24.

A small projection 66 on base 26 of the U-shaped member 24 may also be provided to securely hold the profiled section of the key when the cam wedge 40 is moved downwardly to engage the key. This projection is optional.

Figure 5:
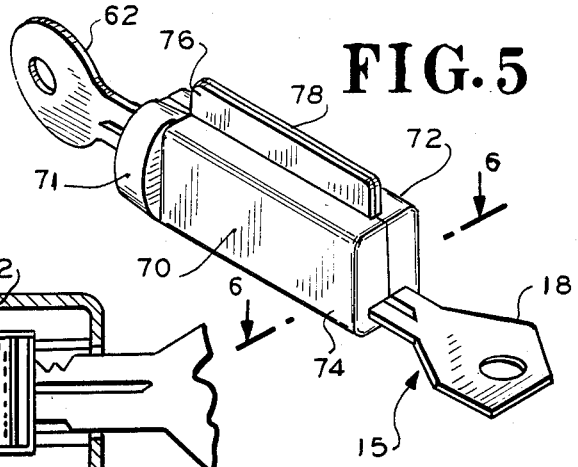
FIG. 5 is a perspective view of another embodiment of a key retaining device.
Figure 6:
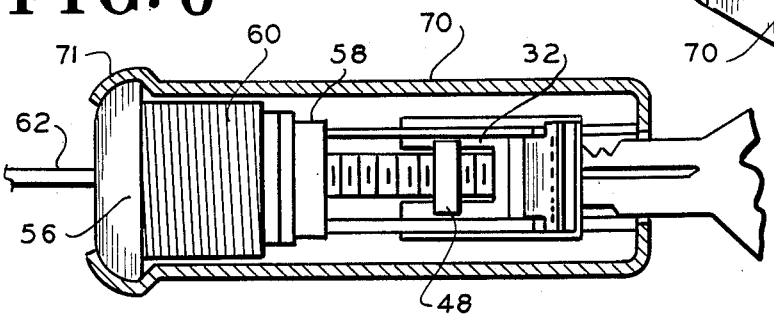
FIG. 6 is a sectional view along the lines 6—6 of the embodiment shown in FIG. 5.
Figure 7:
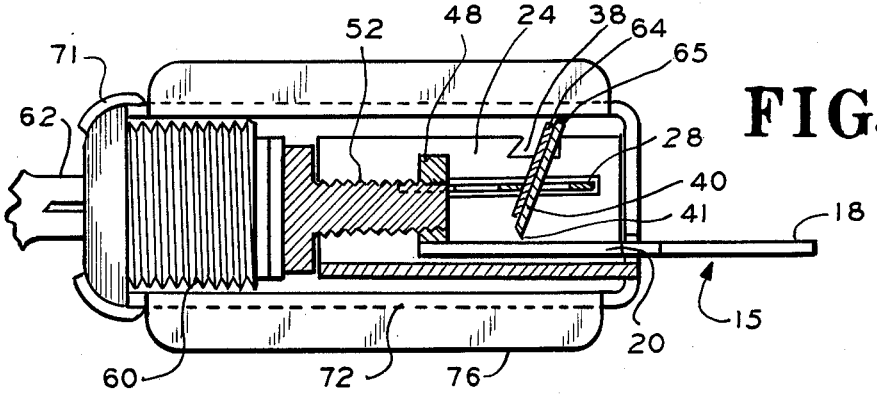
FIG. 7 is a sectional view showing a key securely held in the embodiment shown in FIG. 6.
Figures 8, 9:
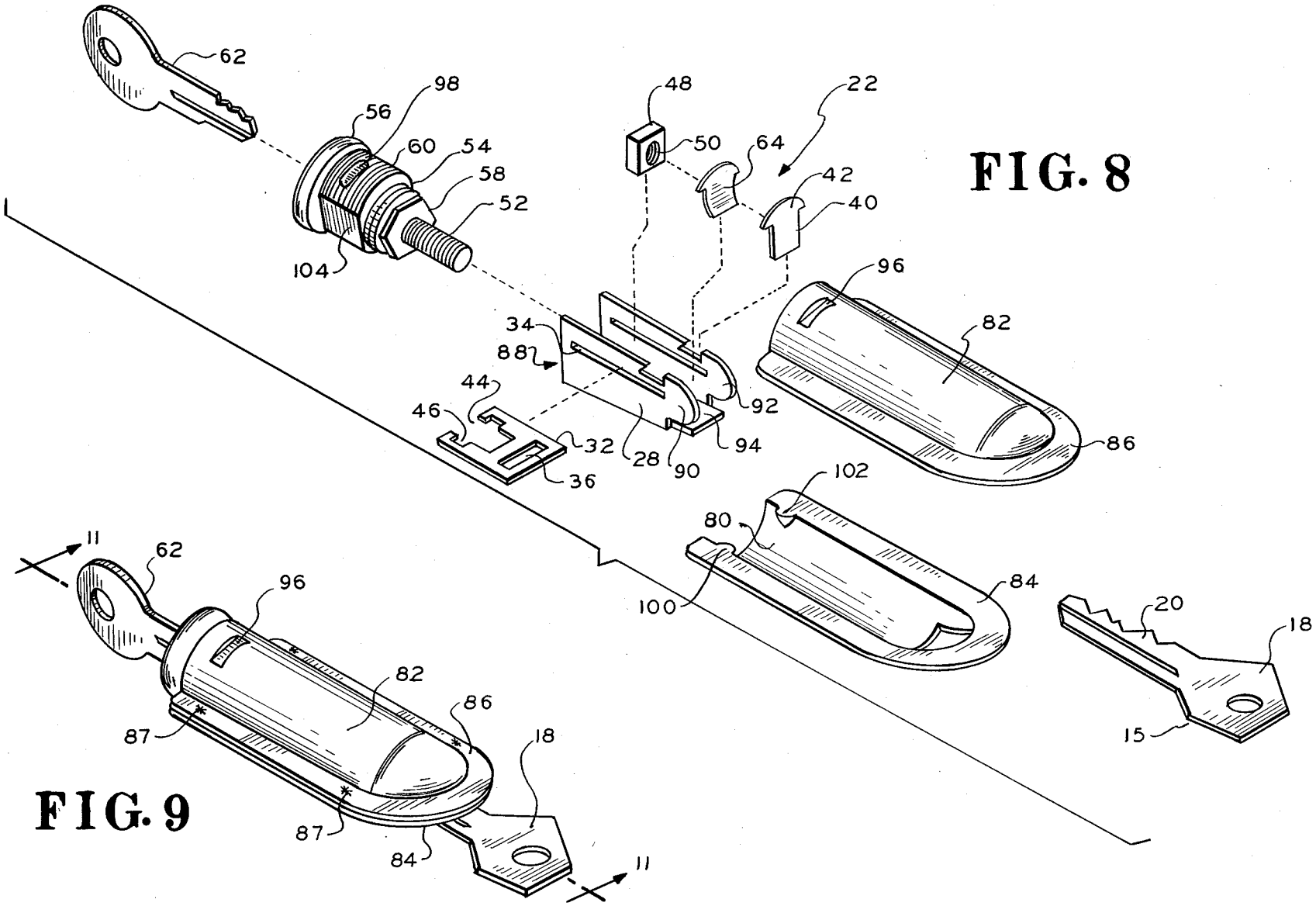
FIG. 8 is an exploded view of still another embodiment of the invention.
FIG. 9 is a perspective view of the latter embodiment assembled showing a key securely held therein.
Figure 10:
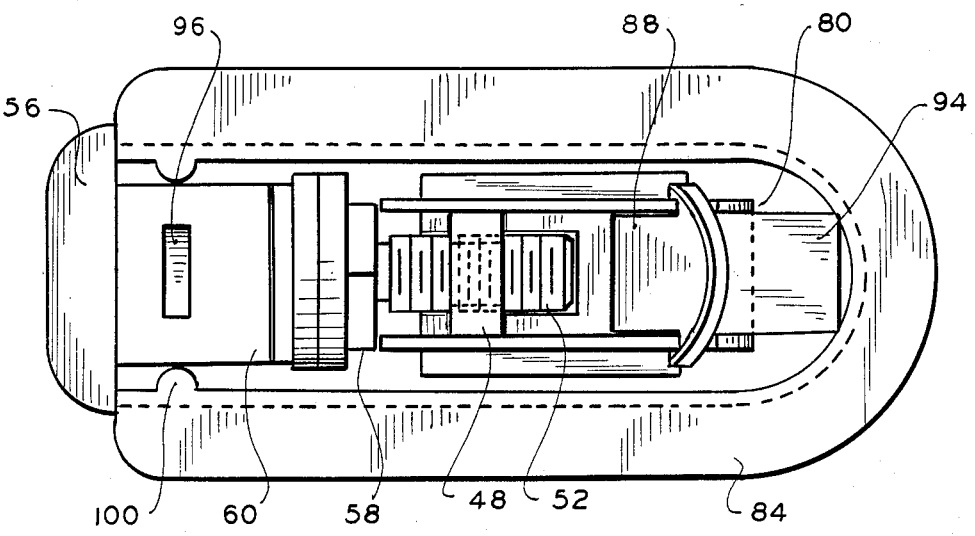
FIG. 10 is a plan view of the latter embodiment with the cover removed.
Figure 11:
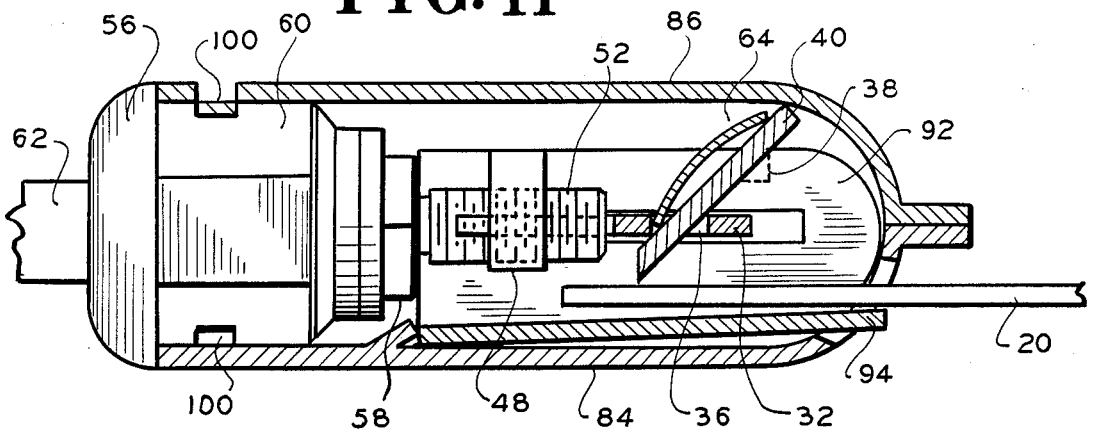
FIG. 11 is a longitudinal sectional view of the latter embodiment, the view being taken along the line 11—11 of FIG. 9.

In a further embodiment of the invention shown in FIGS. 5, 6, and 7, lock 56 is held in one end 71 of a generally parallelapiped split casing 70, the two parts 72, 74 of which may be held securely together by bolts (not shown) or other means which hold flanges 76, 78. As in the previously described embodiment, a nut 48 is held in a slide 32 which moves within a U-shaped channel member 24 when the bolt 52 which is coupled to lock 56 by barrel 60 is threaded into and out of the nut. When the slide member 32 moves to the left the cam wedge 40 is rotated clockwise (in the sense of FIG. 7) so that its bottom edge 41 is lifted from, and releases the key. Similarly when slide member 32 is moved to the right, the cam wedge 40 is moved or rotated counterclockwise (in the sense of FIG. 7), whereby bottom edge 41 moves downward to engage and securely hold the key, as upper edge 65 of member 40 engages the interior of housing 10 to effect a firm wedging action.

In a still further embodiment (FIGS. 8 through 11) of the invention, the casing comprises two generally semi-cylindrical shells 80, 82, each of which have a flange 84, 86. These flanges may be secured together by bolts (not shown) or by welding (as at 87) to form a housing for the key retainer, the ports of which are the same as those shown in and described earlier with reference to FIG. 2, with the exception that the U-shaped channel member 88 has rounded ends 90, 92 and the base 94 of the channel slopes upwardly to fit into the shells 80, 82, the inner walls of which also slope downwardly.

The barrel 54 of lock 56 has a flattened notch 98 for receiving an inwardly projecting portion 96 of cover 82, which is applied after assembly of the device. This prevents lock barrel 54 from turning when the key 62 is turned. The lower portion 80 of the cover has inwardly projecting notches 100, 102 which press against the flattened sides 104 of the lock barrel to effect similar results.

DESCRIPTION OF OPERATION

Reference may be had to FIGS. 1 through 4 in connection with this description of the operation of the present device. The operation of the remaining embodiments are similar. Thus, in operation, key 15 is inserted through the open end 14 of housing 10 into U-shaped channel member 24, as far as possible. Master key 62 is inserted into lock 56, and rotated to partially unthread bolt 52 from nut 48. This causes slide member 32 to move to the right (in the sense of the drawings) causing cam wedge 40 to rotate counterclockwise so that its bottom edge 41 moves downwardly and engages the profiled section 20 of the key, while the upper edge 65 of member 40 abuts the interior of housing 10 to effect a firm wedging action. Further rotation of key 62 allows it to be withdrawn from lock 56. Key 15 is now securely held in the U-shaped channel member by cam wedge 40.

To release key 18, master key 62 must be inserted in lock 56 and rotated to turn bolt 52 and thread it into nut 40. This causes slide 28 to move to the left, causing a clockwise rotation of cam wedge 40, thereby moving its edge 65 from the wall of housing 10 and lifting its engaging edge 41 from key 15, whereby key 15 can be readily withdrawn.

When not in use the key retaining device can be hung from a hook on a keyboard by a ring 72.

Having thus described the invention with reference to a specific embodiment, other modifications will be apparent to those skilled in the art without departing from the scope of the invention which is defined in the following claims.

I claim:

1. A key retaining device for capturing and selectively locking a key having a working section and handle section comprising:

a housing having at least one end wall and a side wall and having a chamber therein;

said end wall having a slot therein communicating with said chamber and dimensioned to receive said working section of said key therethrough; and means for selectively securing said working section of said key, including means to slideably actuate a clamping member to releasably engage and secure said working section of said key within said chamber.

2. A key retaining device as claimed in claim 1 wherein said selective securing means includes a cam wedge.

3. A key retaining device as claimed in claim 2 wherein the cam wedge is resiliently urged by resilient means held in position by lock means and released by insertion of a master key into said lock means.

4. A key retaining device as claimed in claim 2 wherein the actuating means includes a slidable member having a slot therein for receiving the cam wedge.

5. A key retaining device as claimed in 3 or 4 wherein the resilient means is received in said slot with said cam wedge.

6. A key retaining device as claimed in claim 4 further including a channeled member for receiving said slotted member moveably therein, and means coupling said slotted member to said lock means.

7. A key retaining device as claimed in claim 6 wherein said coupling means includes a nut insertable into said slotted member, and further includes a bolt member connected to said lock and cooperating with said channeled member.

8. A key retaining device as claimed in claim 7 wherein the other end of the housing, after insertion of the bolt member in said nut is closed by locking means for releasably securing said wedge means in said slotted member.

9. A key retaining device as claimed in claim 6, 7, or 8 further including resilient means in said slot urging and holding said cam wedge in position by lock means and released by insertion of a master key in said lock.

10. A key retaining device as claimed in claim 3 or 6 wherein said resilient means is a curved wedge-like member.

11. A key retaining device comprising:

(a) a hollow cylindrical housing open at one end to receive a key having a working section and a handle section which remains in said housing;

(b) a channelled member having a transverse slot, said channeled member receiving the working section of the key axially within the housing;

(c) a member slideable within the channeled member, said slideable member having a transverse slot therein;

(d) a wedge member in the transverse slot of the channeled member having a beveled edge portion extending into the transverse slot of said slideable member;

(e) a nut member inserted into said slideable member;

(f) a bolt member insertable into said nut member for moving said slideable member upon threading in said nut thereby moving said wedge member to secure and release a key in said channeled member;

(g) locking means closing the other end of said housing connected to said bolt member for threading and unthreading the bolt member in said nut member thereby locking and unlocking said key.

12. A key retaining device as claimed in claim 11 in which said locking member is releasable with a master key, thereby unthreading said bolt in said nut and releasing said wedge-like member.

13. A key retaining device as claimed in claims 11 or 12 further including a resilient member in said slot with said wedge member.

14. A key retaining device as claimed in claims 11 or 12 in which the resilient member is a curved wedge-like member.

15. A key retaining device as claimed in claims 11 or 12 including a resilient member in said slot with said wedge member and further including a projection on the floor of said channeled member for holding said key when said bolt is threaded into the nut and the wedge is held against the key.

16. A key retaining device for capturing and selectively securing a key having a working section and a handle section, comprising:

a housing having first and second opposed end walls and defining a chamber therein;

the first said end wall having a slot therein communicating with said chamber for receiving said working section of the said key therethrough;

slide means longitudinally displaceable within said chamber;

wedge means moveable in response to displacement of said slide means between a first angular position in which said wedge is out of contact with said working section of said key, and a second angular position wherein said wedge engages both the working section of said key and the interior wall of said housing to effect a wedging action with respect to said key, thereby precluding its withdrawal from said chamber; and means for displacing said slide means within the interior of the said chamber to effect movement of said wedge between said first and second positions.

17. A device in accordance with claim 16 wherein said means for moving said slide means comprises a rotatable shaft threadingly received at the said slide means, said shaft being rotated by means extending therefrom and through said second end wall of said housing.

18. A device in accordance with claim 17, wherein said means for moving said slide comprises a lock, rotation of said shaft being effected by a master key insertable by said operator into said lock.

* * * * *